United States Patent [19]

Trzoska

[11] 4,291,652

[45] Sep. 29, 1981

[54] HYDRAULIC TAPPET

[75] Inventor: Peter R. Trzoska, Cologne, Fed. Rep. of Germany

[73] Assignee: Ford Motor Company, Dearborn, Mich.

[21] Appl. No.: 78,880

[22] Filed: Sep. 26, 1979

[30] Foreign Application Priority Data

Sep. 10, 1978 [DE] Fed. Rep. of Germany ..... 2843918

[51] Int. Cl.[3] ..... F01L 1/14; F01L 1/24

[52] U.S. Cl. ..... 123/90.57; 123/90.55; 123/90.6

[58] Field of Search ..... 123/90.46, 90.55, 90.57, 123/90.60, 90.63

[56] References Cited

U.S. PATENT DOCUMENTS

| | | | |
|---|---|---|---|
| 2,010,167 | 8/1935 | Tibbetts | 123/90.55 |
| 2,966,151 | 12/1960 | Wood | 123/90.55 |
| 3,385,274 | 5/1968 | Shunta et al. | 123/90.57 |
| 3,875,910 | 4/1975 | Zink | 123/90.55 |
| 4,152,953 | 5/1979 | Headley | 123/90.6 |

FOREIGN PATENT DOCUMENTS

| | | |
|---|---|---|
| 1033459 | 12/1958 | Fed. Rep. of Germany . |
| 1757954 | 6/1971 | Fed. Rep. of Germany . |

*Primary Examiner*—Craig R. Feinberg
*Assistant Examiner*—W. Wolfe
*Attorney, Agent, or Firm*—Steven L. Permut; Clifford L. Sadler

[57] ABSTRACT

A hydraulic tappet includes a tubular cylinder sideable within a bore of a housing, a piston with a reservoir slideably mounted within the tubular cylinder, a lower piston spring biased away from the piston with the reservoir forming a pressure chamber therebetween. The reservoir being in open communication with pressure oil ports and the pressure chamber selectively being closed or open to said reservoir. The closing or opening of the pressure chamber being controlled by the lower piston and cylinder riding on tracks of a cam which control the relative position of the cylinder and lower piston.

6 Claims, 2 Drawing Figures

HYDRAULIC TAPPET

BACKGROUND OF THE INVENTION

Field of the Invention

The invention relates to a hydraulic tappet in a valve actuating mechanism, and more particularly to a hydraulic tappet for a valve train in an internal combustion engine.

Description of the Prior Art

A hydraulic tappet in a valve actuating mechanism of an internal combustion engine is known. German Pat. No 1 033 459 discloses an example of the above.

The known hydraulic tappet automatically compensates, in response to lubricating oil pressure in the tappet, for any play or lash in the valve actuating mechanism of the internal combustion engine. Such known hydraulic tappets with automatic length compensation include a tappet cylinder actuated by a cam and a tappet piston arranged slidingly and spring loaded therein, constructed to actuate a valve directly or indirectly. The tappet piston contains a reservoir chamber permanently loaded by the lubricating oil pressure and is movable in the direction of play compensation by a pressure chamber connectible to said reservoir chamber under certain conditions.

During the transmission of movements and forces between cam and rocker lever or valve, the tappet piston is supported through the oil column enclosed in the pressure chamber against the tappet cylinder when a check valve within the tappet is closed and thus the tappet constitutes a virtually rigid connection.

In the case of an increase of play in the valve actuating mechanism, the length of the hydraulic tappet is increased by the spring loaded tappet piston being urged away from the bottom of the tappet cylinder so that a vacuum is produced in the pressure chamber which in conjunction with the lubricating oil pressure chamber causes the check valve to open and lubricating oil to flow out of the reservoir chamber into the pressure chamber until the existing play has been eliminated.

The compensating hydraulic tappet is also capable of being shortened where there is a reduction of play in the valve actuating mechanism. Oil can escape or leak from the pressure chamber at the peripheral gap between tappet piston and tappet cylinder until the necessary reduction of play has been compensated. The oil leaks from the pressure chamber due to powerful compressive forces generated by the cam and valve and a rapid buildup in oil pressure.

Although the known hydraulic tappets in valve actuating mechanisms of internal combustion engines achieve considerable advantages such as the reduction of the noise level and the avoidance of valve play adjustment operations, they exhibit drawbacks. These drawbacks include a limitation of the maximum camshaft speed, restrictions to gentle cam contours, and stringent demands as to freedom from trapped air in the lubricating oil. The individual points which produce these disadvantages are listed hereinbelow.

In order to permit the passage of the lubricating oil from the reservoir chamber into the pressure chamber, which is necessary in the case of an increase in play, it is necessary for the pressure of the lubricating oil supply to overcome the resistance of the check valve. The oil system must maintain a minimum pressure. The minimum pressure must be maintained at idle speed and maximum oil temperature which dictates a correspondingly large capacity lubricating oil pump and a low resistance design of the lubricating oil passages in the engine.

The arrangement of the check valve in the pressure chamber, which is dictated by design considerations, leads to a relatively large volume in the pressure chamber so that the static rigidity of the oil column $c=BA^2/V$ (where B=compressibility module of the oil, A=effective piston area, and V=volume of pressure chamber) diminishes and thus, negatively influences the natural frequency and the transmission function of the valve actuating mechanism.

In order to ensure the automatic length compensation of the hydraulic tappet in the case of play reduction, relatively large gap widths are necessary at the peripheral gap between tappet piston and tappet cylinder, since otherwise it would be impossible to obtain a corresponding rapid shortening of the hydraulic tappet in the warming-up phase of the engine when immediate power demands lead to a rapid heating of the engine and hence to rapid length increases in the valve actuating mechanism and increases in the volume of the oil in the pressure chamber.

However, the large gap widths which are necessary for the above stated reasons have a disadvantageous influence on the dynamic rigidity of the hydraulic tappet specifically at higher oil temperatures and higher forces. In addition to the diminished static rigidity of the oil column due to a great volume of the pressure chamber, the dynamic rigidity is diminished due to a constant tendency to shorten the hydraulic tappet by leakage at the peripheral gap between the tappet piston and cylinder defined by equation:

$Q=ps^3b/12nl$ (Q+leakage flow, P=pressure in pressure chamber, S=radical gap, b=gap width, 1=gap length, and n=viscosity of oil).

A further problem in the known hydraulic tappets occurs when the engine is switched off and switched back on after a period of time. The known hydraulic tappets are designed to allow air to be sucked from the reservoir into the pressure chamber if the hydraulic tappet is stopped in the open position. The introduction of air into the pressure chamber renders the hydraulic tappet inoperable for a period of time upon the next operation of the engine which results in objectionable rattling and shortened valve strokes. Further difficulties with known hydraulic tappets result from the fact that when the valve speed limit is attained at which the rocker lever and tappet are no longer pressed against the cam by the valve spring, a recoil of the oil column in the pressure chamber results in the suction of oil and hence to an undesirable pumping-up of the hydraulic tappet which leads to the destruction of the tappet. Natural vibrations of the hydraulic tappet due to insufficient rigidity can also lead to the destructive pumping-up.

SUMMARY OF THE INVENTION

According to the invention, a hydraulic tappet for a valve actuating mechanism includes a tappet cylinder slideably receiving a tappet piston defining in part a reservoir chamber. The tappet piston has an end portion engagable to a valve mechanism. A second piston is also slidably disposed in the cylinder and spaced apart from the tappet piston to define a pressure chamber therebetween.

Further, according to the invention, a passageway fluidly connects the reservoir chamber to the pressure chamber when the cylinder is in a first position relative to the tappet piston. Preferably the passageway includes an annular recessed groove circumscribing the outer surface of a sidewall of the tappet piston having a port extending therefrom and in fluid communication with the reservoir. The tappet cylinder is tubular in shape and its inner wall defines the sidewall of the pressure chamber. A longitudinal extending recessed groove is formed in the inner sidewall of the tubular cylinder with the recessed groove axially positioned in the cylinder such that the groove is in fluid communication with the pressure chamber and the annular groove and the tappet piston when a cylinder is in a first axial position with respect to the tappet piston.

Further, according to the invention the passageway has a closing system between the reservoir chamber and the pressure chamber to close off the passageway when the cylinder is in the second axial position relative to the tappet position. Preferably, the closing system includes a shoulder defining the lower end of the longitudinal groove in the tappet cylinder with the shoulder located above the bottom end of the tappet cylinder to cut off fluid communication between the longitudinal groove and the pressure chamber when the cylinder is in the second axial position with respect to the tappet piston.

Further, according to the invention, a cam has a first cam surface engageable with the cylinder and a second cam surface engageable with the second piston with the two cam surfaces having disaligned portions positioned such that one cam surface is recessed with respect to the other cam surface and other portions of the two surfaces where the one cam surface is less recessed with respect to the other cam surface. Preferably, the cam includes a camshaft having a cam thereon which includes a base circle portion and a transitional and elevational portion with the first cam surface recessed with respect to the second cam surface at the base circle portion and level with the second cam surface at the transitional and elevational portion of the cam.

The cylinder is mountable within a bore of a housing of the valve actuating mechanism and the reservoir chamber is fluidly connectable to a pressurized hydraulic fluid supply such that when the passageway is open, fluid passes therethrough into the pressure chamber to separate the two pistons to a predetermined distance. Preferably, the reservoir chamber is connectable to the hydraulic fluid supply by an annular groove axially spaced from said first annular groove circumscribing the outer wall of the tappet piston and a second port extending from the second groove through the sidewall to the reservoir chamber. An annular recessed groove circumscribes the outer surface of the tubular cylinder with a port extending therefrom and through the sidewall of the cylinder and in fluid communication with the second annular groove in the tappet piston. The valve actuating mechanism housing has an outlet leading from a pressurized hydraulic fluid supply and in communication with the port extending through the cylinder.

BRIEF DESCRIPTION OF THE DRAWINGS

The invention will be more fully explained with reference to an exemplary embodiment illustrated in the accompanying drawing, wherein.

DETAILED DESCRIPTION OF THE PREFERRED EMBODIMENT

Figure 1:
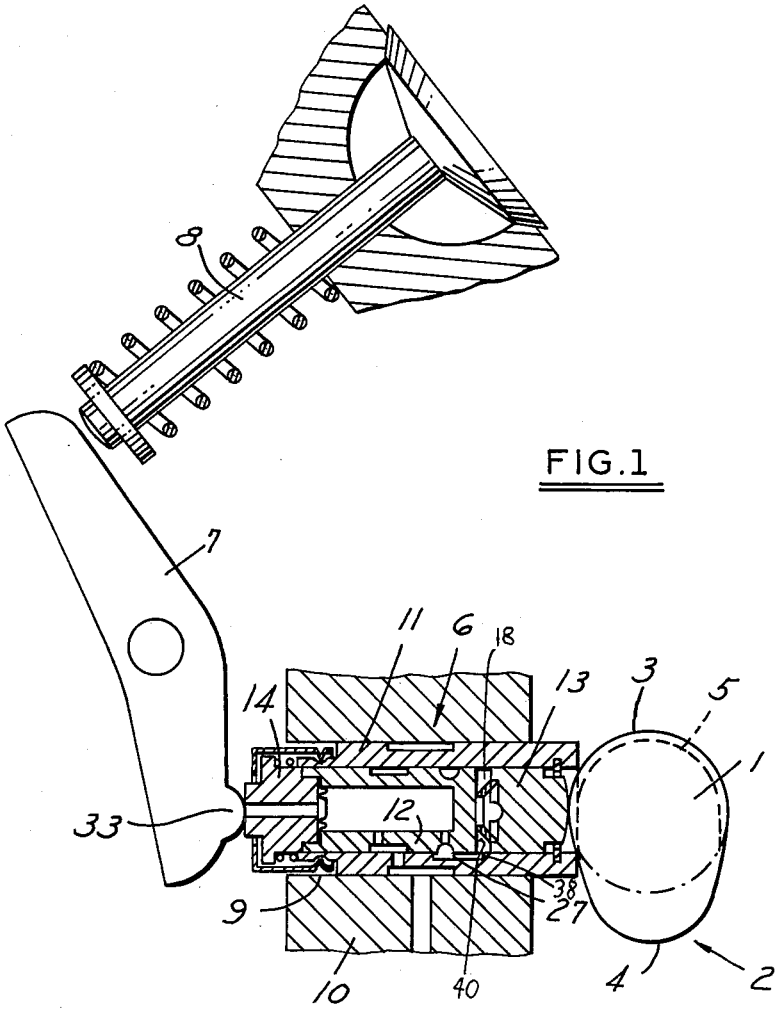
FIG. 1 shows a precontrolled hydraulic tappet in a valve actuating mechanism of an internal combustion engine.

FIG. 1 shows schematically the valve actuating mechanism of a valve train of an internal combustion engine. A camshaft 1 has cam 2 which includes, in addition to the regions of a base circle 3 and of a cam elevation 4, spaced tracks 5 on both sides of base circle 3 are recessed with respect to the surface of base circle 3. The cam 2 of the camshaft 1 cooperates with the one end of a hydraulic tappet 6, the other end of which cooperates with the one end of a rocker arm 7. The other end of the rocker arm 7, in turn, actuates a valve 8 of the internal combustion engine in known manner. The hydraulic tappet 6 is guided slideably in a tappet bore 9 in the cylinder head 10 of the internal combustion engine in a conventional manner.

Figure 2:
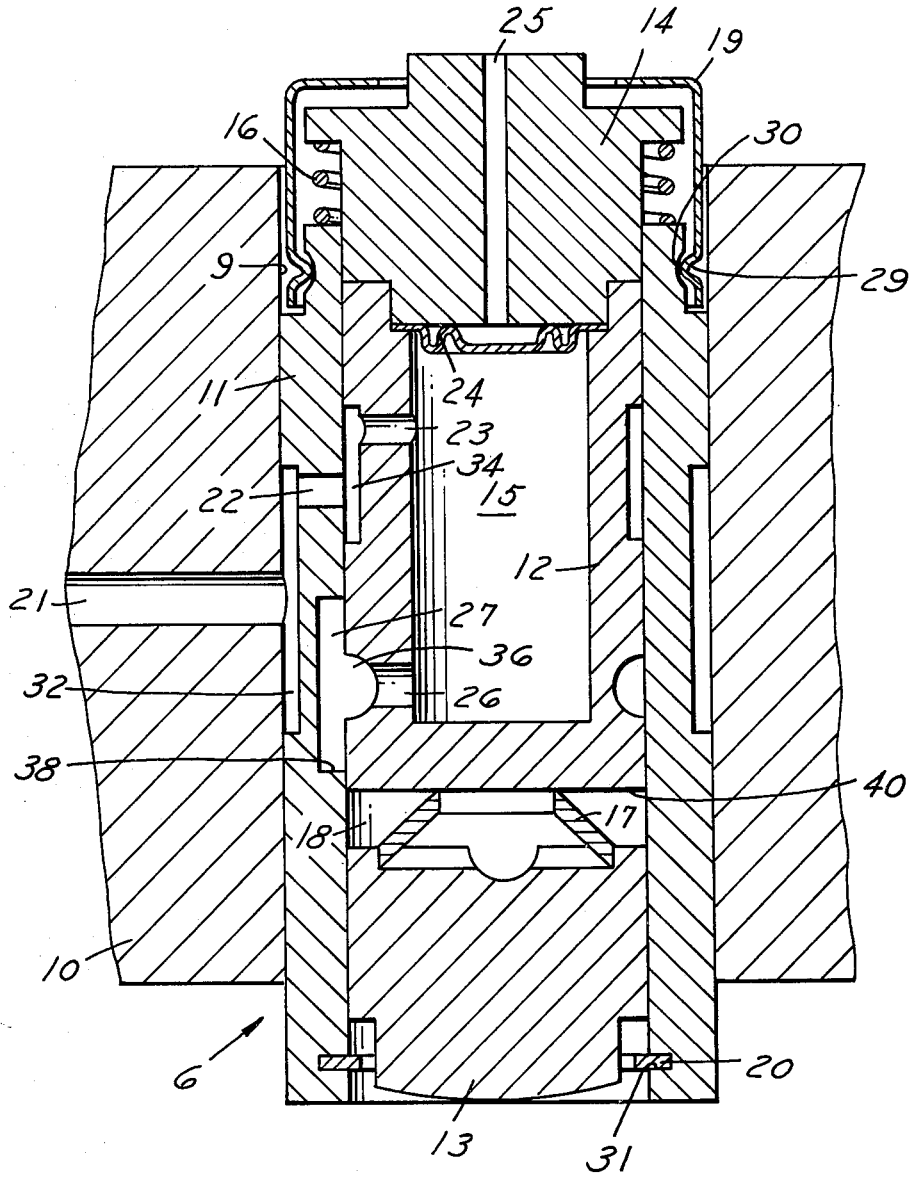
FIG. 2 shows, an enlarged side elevational view of the precontrolled hydraulic tappet shown in FIG. 1.

FIG. 2 shows the hydraulic tappet 6 in a larger scale section. It comprises a tubular tappet cylinder 11 in which a spring loaded tappet piston 12 and a bottom piston 13 are arranged coaxially and slidably. The tappet piston 12 is of hollow construction and closed at its upper end with a rigidly fixed terminal piece 14. The interior of the tappet piston 12 forms a reservoir chamber 15 in which air foamed oil can settle.

Between a shoulder of the terminal piece 14 and the upper end of the tappet cylinder 11 there is arranged a coil spring 16. Spring 16 biases the tappet cylinder 11 into abutting engagement with the cam on the camshaft and the terminal piece 14 into engagement with the rocker arm.

Between the tappet piston 12 and the bottom piston 13 there is arranged a cup or Belleville spring 17 which biases the tappet piston 12 towards the rocker arm 7 and the bottom piston 13 towards the cam on the camshaft. A pressure chamber 18 is formed between the tappet piston 12 and the bottom piston 13. The chamber 18 can be kept comparatively small in volume due to the short overall height of the cup spring 17.

The components 11, 12, 13 and 14 of the hydraulic tappet 6 are assembled firstly by a sheetmetal sleeve 19 having an inwardly directed ridge 29 that is positioned in a groove 30 in the tappet cylinder 11, and secondly by an annular clip 20 snugly received in a slot 31 at the lower end of the tappet cylinder 11.

The reservoir chamber 15 formed in the tappet piston 12 communicates permanently; through a lubricating oil pressure passage 21, an orifice 22 leading from an annular groove 32 in the tappet cylinder 11, and an orifice 23 leading from the annular groove 34 in the tappet piston 12, with the lubricating oil pressure system of the internal combustion engine.

The lubricating oil which is fed under pressure to the reservoir chamber 15 is able, to pass through an aperture (not shown) in throttle 24 and a duct 25 in terminal piece 14 to the bearing portion 33 of the rocker arm 7. In addition, an orifice 26 extends from reservoir chamber 15 to an annular groove 36 recessed within the outside of tappet piston 12. The groove 36 is axially aligned with a longitudinally extending groove 27 in cylinder 11. The groove 27 has a bottom end formed by shoulder 38 integral with cylinder 11.

OPERATION OF THE EMBODIMENT

In order to explain the operation of the precontrolled hydraulic tappet 6, we now consider FIG. 1. When the tappet 6 engages the cam 2 during its rotation in that portion of the cam contour between the cam elevation and the base circle 3, no rigid connection through the hydraulic cam is required. Accordingly, the cam surfaces of base circle and tracks 5 engaging bottom piston 13 and the tappet cylinder 11 respectively deviate from one another; that is, bottom piston 13 is supported on the surface of base circle 3, whereas the tappet cylinder 11 engages lateral recessed tracks 5. Bottom piston 13 and tappet piston 12 are thereby displaced relatively to the tappet cylinder 11 to the extent tracks 5 are recessed from base circle 3. The coil spring 16 biases the cylinder downward to promote displacement of the tappet cylinder 11 with reference to the tappet piston 12. During the displacement, the connecting passage 27 is sufficiently lowered such that shoulder 38 is below the bottom end 40 of tappet piston 12 and forms an uninterrupted passage through orifice 26, groove 36, and groove 27 from reservoir chamber 15 to pressure chamber 18. FIG. 1 shows the cylinder in its displaced position. Lubricating oil under pressure from passage 21 and in reservoir 15 can be supplied to the pressure chamber 18 in conformity with the conditions of the valve actuating mechanism, namely, engagement of play between the camshaft and rocker arm. Conversely, oil from chamber 18 may be displaced therefrom back to reservoir chamber 15 if there is a reduction of play between the camshaft and rocker arm. The pressure chamber 18 is closed from the reservoir chamber 15.

The tappet piston and shoulder 38 rises above bottom 40 of piston 12 when the track 5 becomes even with the transitional portion between the cam elevation 4 and base circle 3 so that the hydraulic tappet again acts in a desired manner as a rigid connection, when cam elevation 4 pushes tappet to open the valve. FIG. 2 shows the tappet in its rigid mode.

The following advantages are achieved by the novel precontrolled hydraulic tappet by comparison with the known hydraulic tappets. First, due to the fact that the fluid communication between the reservoir chamber and the pressure chamber is precontrolled and does not occur by overcoming the resistance of a nonreturn valve, the requirements as to the minimum lubricating oil system pressure are less stringent.

Second, because it is unnecessary to arrange a nonreturn valve in the pressure chamber, the pressure chamber can be made extremely small with the result that the static rigidity and natural frequency of the hydraulic tappet are substantially improved and the influence of air foamed lubricating oil on the rigidity is greatly reduced.

Third, due to the positive precontrol of the hydraulic tappet, the difficulties which previously occurred during the warmingup phase of a cold engine are largely avoided by rapid reduction of play in the valve actuating mechanism and increases in volume in the pressure chamber. Due to the controlled opening of the connection between the reservoir chamber and the pressure chamber at each camshaft revolution, even in the case of a rapid reduction of play in the valve actuating mechanism, the volume of oil enclosed in the pressure chamber can be correspondingly adapted and the gap widths at the circumference between tappet piston and tappet cylinder can be made optimally small.

Fourth, because the gap widths can be made optimally small, the dynamic rigidity of the hydraulic tappet, and hence its transmission properties, are further considerably improved.

Fifth, due to the smaller volume of lubricating oil flowing through the smaller gaps, the hydraulic tappet is less sensitive to air foamed lubricating oil and facilitates the discharge of any air bubble which forms when the internal combustion engine is stopped. Due to the positive control of the connection between the reservoir chamber and the pressure chamber, pumpingup of the hydraulic tappet is no longer possible.

These advantages of the precontrolled hydraulic tappet in a valve actuating mechanism of an internal combustion engine ensure reliable functioning, even at high oil temperatures, high speeds and sharp cam elevations without excessive demands as to the freedom from air of the lubricating oil.

The invention is not restricted to the exemplary embodiment illustrated and described in which the tappet cylinder is responsible for controlling the connecting cross-section. On the contrary, other embodiments are also conceivable in which a valve slide element sliding in the hydraulic tappet is controlled by a track on the camshaft.

Variations and modifications are possible within the spirit and scope of the invention as defined by the appended claims.

The embodiments of the invention in which an exclusive property or privilege is claimed are defined as follows:

1. A hydraulic tappet for a valve train of an internal combustion engine comprising;

a tappet piston defining a reservoir chamber;

a tappet cylinder slideably receiving said tappet piston;

a second lower piston slideably disposed in said cylinder and spaced apart from said tappet piston to define a pressure chamber therebetween;

the tappet cylinder being tubular in shape and defining a sidewall of said pressure chamber:

a camshaft having a cam surface thereon with a base circle portion and transitional and elevational portions;

a track surface laterally spaced and recessed on each side of said base circle portion and level with said transitional and elevational portions;

said track surface engaging an end of said cylinder and said cam surface engaging an end of said second piston;

a passageway fluidly connecting said reservoir with said pressure chamber when said cylinder is in a first position with respect to said tappet piston;

said passageway includes an annular recessed groove circumscribing the outer surface of a sidewall of said tappet piston having a port extending therethrough between said groove and reservoir chamber, a longitudinal groove recessed in an inner sidewall of said tubular cylinder, said longitudinal groove located on said cylinder to be constantly in fluid communication with said annular groove in said tappet piston and in fluid communication with said pressure chamber when said cylinder is in a first axial position with respect to said tappet piston;

a shoulder defining the bottom end of said longitudinal groove integral with said cylinder with said shoulder located above the bottom end of said tappet piston to cut off fluid communication between said longitudinal groove and said pressure chamber when said cylinder is in a second axial position with respect to said tappet piston;

a Belleville spring mounted within said pressure chamber biasing said tappet piston and lower piston apart from each other;

said reservoir chamber connectable to a pressurized fluid supply in said internal combustion engine through a passageway extending through said tubular cylinder such that when said reservoir is fluidly connected to said pressure chamber, fluid passes between the said two chambers to separate the two pistons a predetermined distance.

2. A hydraulic tappet for a valve actuating mechanism comprising:

a tappet piston defining a reservoir chamber;

a tappet cylinder slideably receiving said tappet piston;

said tappet piston having an end portion engageable to a valve mechanism;

a second piston slideably disposed in said cylinder and spaced apart from said tappet piston to define a pressure chamber therebetween;

cam means having a first cam surface engageable with said cylinder and a second cam surface engageable with said second piston;

said cam surfaces having portions positioned such that one cam surface is disaligned with respect to the other cam surface and other portions where said one cam surface is less recessed with respect to said other cam surface;

a passageway fluidly connecting said reservoir chamber to said pressure chamber when said cylinder is in a first position relative to said tappet piston;

means for closing said passageway between said reservoir chamber and said pressure chamber when said cylinder is in a second position relative to said tappet piston;

said cam means engaging said cylinder and second piston for moving said cylinder between said first and second position with respect to said tappet cylinder;

said cylinder being slideably mountable in a bore of a housing of said valve actuating mechanism;

said reservoir chamber fluidly connectable to a pressurized hydraulic fluid supply such that when said passageway is open, fluid passes therethrough in one direction of one of into and out of said pressure chamber to separate said two pistons a predetermined distance;

said second piston, pressure chamber, and tappet piston forming a rigid tappet when said pressure chamber is filled with hydraulic fluid and when said passageway is closed;

said cylinder being tubular in shape and defining the sidewall of the pressure chamber;

said passageway including:

a first annular recessed groove circumscribing the outer surface of a sidewall of said tappet piston having a port between the groove and the reservoir chamber;

a longitudinally extending recessed groove in an inner sidewall of said tubular cylinder;

said longitudinally extending recessed groove located on said cylinder such that said longitudinal extending groove is in fluid communication with said pressure chamber and said annular groove in said tappet piston when said cylinder is in a first axial position with respect to said tappet piston.

3. A hydraulic tappet as defined in claim 1 wherein; said longitudinal groove in said cylinder is constantly in fluid communication with said annular groove in said tappet piston and said closing means includes a shoulder defining the lower end of said longitudinal groove with said shoulder located above the bottom end of said tappet piston to cut off fluid communication between said longitudinal groove and said pressure chamber when said cylinder is in said second axial position with respect to said tappet piston.

4. A hydraulic tappet as defined in claim 3 wherein; said cam means includes;

a camshaft, a cam on said camshaft having a base circle portion and elevational and transitional portions with said first cam surface recessed with respect to said second cam surface at the base circle portion and level with said second cam surface at the transitional and elevational portions of said cam.

5. A hydraulic tappet as defined in claim 3 wherein;

said reservoir chamber is connectable to the pressurized hydraulic fluid supply by a second annular recessed groove circumscribing the outer surface of the sidewall of said tappet piston and a second port extending from the second groove through the sidewall of the tappet piston to the reservoir chamber;

a third annular recessed groove circumscribing an outer surface of wall of the tubular cylinder with a port extending therefrom and through the sidewall of the cylinder and in fluid communication with the second annular recessed groove in the tappet piston;

said cylinder mountable in the bore of said housing of said valve actuating mechanism with said housing having an outlet leading from the pressurized hydraulic fluid supply and in communication with said third annular groove in said cylinder.

6. A hydraulic tappet as defined in claim 1 or 3 wherein;

a Belleville spring is positioned within said pressure chamber and abuts said tappet piston and said second piston to bias said pistons away from each other toward a rocker arm and said cam means respectively.

* * * * *